US010827295B2

(12) United States Patent
Boehm et al.

(10) Patent No.: US 10,827,295 B2
(45) **Date of Patent: *Nov. 3, 2020**

(54) METHOD AND APPARATUS FOR GENERATING 3D AUDIO CONTENT FROM TWO-CHANNEL STEREO CONTENT

(71) Applicant: DOLBY LABORATORIES LICENSING CORPORATION, San Francisco, CA (US)

(72) Inventors: Johannes Boehm, Göttingen (DE); Xiaoming Chen, Hannover (DE)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/560,733

(22) Filed: Sep. 4, 2019

(65) Prior Publication Data

US 2020/0008001 A1 Jan. 2, 2020

Related U.S. Application Data

(62) Division of application No. 15/761,351, filed as application No. PCT/EP2016/073316 on Sep. 29, 2016, now Pat. No. 10,448,188.

(30) Foreign Application Priority Data

Sep. 30, 2015 (EP) ..... 15306544

(51) Int. Cl.

| | |
|---|---|
| ***H04S 7/00*** | (2006.01) |
| ***H04S 5/00*** | (2006.01) |
| ***H04S 1/00*** | (2006.01) |

(52) U.S. Cl.

CPC ..... *H04S 7/302* (2013.01); *H04S 1/007* (2013.01); *H04S 5/00* (2013.01); *H04S 7/30* (2013.01);

(Continued)

(58) Field of Classification Search

CPC . H04S 7/302; H04S 1/007; H04S 5/00; H04S 7/30; H04S 2400/05; H04S 2400/11; H04S 2420/11

See application file for complete search history.

(56) References Cited

U.S. PATENT DOCUMENTS 5,261,109 A * 11/1993 Cadambi ..... G06F 13/374 710/111
5,714,997 A * 2/1998 Anderson ..... G02B 27/017 348/39

(Continued)

FOREIGN PATENT DOCUMENTS

EP 2765791 A1 8/2014

OTHER PUBLICATIONS

Avendano, C. et al "A Frequency-Domain Approach to Multichannel Upmix" JAES vol. 52, Issue 7/8, pp. 740-749, Jul. 2004, published on Jul. 15, 2004.

(Continued)

*Primary Examiner* — Andrew L Sniezek

(57) ABSTRACT

For generating 3D audio content from a two-channel stereo signal, the stereo signal (x(t)) is partitioned into overlapping sample blocks and is transformed into time-frequency domain. From the stereo signal directional and ambient signal components are separated, wherein the estimated directions of the directional components are changed by a predetermined factor, wherein, if changes are within a predetermined interval, they are combined in order to form a directional centre channel object signal. For the other directions an encoding to Higher Order Ambisonics HOA is performed. Additional ambient signal channels are generated by de-correlation and rating by gain factors, followed by encoding to HOA. The directional HOA signals and the ambient HOA signals are combined, and the combined HOA (Continued)

signal and the centre channel object signals are transformed to time domain.

8 Claims, 6 Drawing Sheets

(52) U.S. Cl.
CPC ..... *H04S 2400/05* (2013.01); *H04S 2400/11* (2013.01); *H04S 2420/11* (2013.01)

(56) References Cited

U.S. PATENT DOCUMENTS

| | | | | |
|---|---|---|---|---|
| 10,448,188 | B2 * | 10/2019 | Boehm | H04S 5/00 |
| 2008/0267413 | A1 | 10/2008 | Faller | |
| 2008/0298597 | A1 | 12/2008 | Turku | |
| 2009/0092259 | A1 | 4/2009 | Jot | |
| 2011/0299702 | A1 | 12/2011 | Faller | |
| 2014/0233762 | A1 | 8/2014 | Vilkamo | |
| 2015/0248891 | A1 * | 9/2015 | Adami | H04S 7/30 381/303 |
| 2015/0256958 | A1 | 9/2015 | Nguyen | |
| 2015/0380002 | A1 | 12/2015 | Uhle | |
| 2017/0063960 | A1 * | 3/2017 | Stockhammer | H04L 65/607 |
| 2017/0251323 | A1 * | 8/2017 | Jo | H04S 5/00 |

OTHER PUBLICATIONS

Avendano, C. et al "Ambience Extraction and Synthesis from Stereo Signals for Multi-Channel Audio Up-Mix" IEEE, 2002, pp. 1957-1960.

Briand, M. et al "Parametric Representation of Multichannel Audio Based on Principal Component Analysis" AES presented at the 120th Convention, May 20-23, 2006, Paris, France,pp. 1-14.

Faller, Christof "Multiple-Loudspeaker Playback of Stereo Signals" J. Audio Engineering Society, vol. 54, No. 11, Nov. 2006, pp. 1051-1064.

Goodwin, M. et al "Spatial Audio Scene Coding" AES presented at the 125th Convention, Oct. 2-5, 2008, San Francisco, CA, USA, pp. 1-8.

ISO/IEC CD 23008-3 "Information Technology-High Efficiency Coding and Media Delivery in Heterogenous Environments" Part 3: 3D Audio Apr. 4, 2014, ISO/IEC JTC 1/SC 29/WG 11.

Pulkki, V. " Spatial Sound Reproduction with Directional Audio Coding" J. Audio Engineering Society, vol. 55, No. 6, Jun. 2007, pp. 503-516.

Pulkki, Ville "Spatial Sound Reproduction with Directional Audio Coding" J. Audio Engineering Society, vol. 55, No. 5, Jun. 2007, pp. 503-516.

Pulkki, Ville "Virtual Sound Source Positioning Using Vector Base Amplitude Panning" J. Audio Engineering Society, vol.45, No. 6, Jun. 1997, pp. 456-466.

Rafaely, B. "Plane Wave Decomposition of the Sound Field on a Sphere by Spherical Convolution" May 2003.

Thompson, J. et al "Direct-Diffuse Decomposition of Multichannel Signals Using a System of Pairwise Correlations" AES presented at the 133rd Convention, Oct. 26-29, 2012, San Francisco, CA, USA, pp. 1-15.

Walther, A. et al "Direct-Ambient Decomposition and Upmix of Surround Signals" IEEE Workshop on Applications of Signal Processing to Audio and Acoustics, Oct. 16-19, 2011, New Paltz, NY.

Williams, Earl G. "Fourier Acoustics" Chapter 6 Spherical Waves, pp. 183-196, 1999.

* cited by examiner

METHOD AND APPARATUS FOR GENERATING 3D AUDIO CONTENT FROM TWO-CHANNEL STEREO CONTENT

CROSS-REFERENCE TO RELATED APPLICATION

This application is division of U.S. patent application Ser. No. 15/761,351, filed Mar. 19, 2018, which claims priority to European Patent Application No. 15306544.6, filed on Sep. 30, 2015, which is incorporated herein by reference in its entirety.

TECHNICAL FIELD

The invention relates to a method and to an apparatus for generating 3D audio scene or object based content from two-channel stereo based content.

BACKGROUND

The invention is related to the creation of 3D audio scene/object based audio content from two-channel stereo channel based content. Some references related to up mixing two-channel stereo content to 2D surround channel based content include: [2] V. Pulkki, "Spatial sound reproduction with directional audio coding", J. Audio Eng. Soc., vol. 55, no. 6, pp. 503-516, June 2007; [3] C. Avendano, J. M. Jot, "A frequency-domain approach to multichannel upmix", J. Audio Eng. Soc., vol. 52, no. 7/8, pp. 740-749, July/August 2004; [4] M. M. Goodwin, J. M. Jot, "Spatial audio scene coding", in Proc. 125th Audio Eng. Soc. Conv., 2008, San Francisco, Calif.; [5] V. Pulkki, "Virtual sound source positioning using vector base amplitude panning", J. Audio Eng. Soc., vol. 45, no. 6, pp. 456-466, June 1997; [6] J. Thompson, B. Smith, A. Warner, J. M. Jot, "Direct-diffuse decomposition of multichannel signals using a system of pair-wise correlations", Proc. 133rd Audio Eng. Soc. Conv., 2012, San Francisco, Calif.; [7] C. Faller, "Multiple-loudspeaker playback of stereo signals", J. Audio Eng. Soc., vol. 54, no. 11, pp. 1051-1064, November 2006; [8] M. Briand, D. Virette, N. Martin, "Parametric representation of multichannel audio based on principal component analysis", Proc. 120th Audio Eng. Soc. Conv., 2006, Paris; [9] A. Walther, C. Faller, "Direct-ambient decomposition and upmix of surround signals", Proc. IWASPAA, pp. 277-280, October 2011, New Paltz, N.Y.; [10] E. G. Williams, "Fourier Acoustics", Applied Mathematical Sciences, vol. 93, 1999, Academic Press; [11] B. Rafaely, "Plane-wave decomposition of the sound field on a sphere by spherical convolution", J. Acoust. Soc. Am., 4(116), pages 2149-2157, October 2004.

Additional information is also included in [1] ISO/IEC IS 23008-3, "Information technology—High efficiency coding and media delivery in heterogeneous environments—Part 3: 3D audio".

SUMMARY OF INVENTION

Loudspeaker setups that are not fixed to one loudspeaker may be addressed by special up/down-mix or re-rendering processing.

When an original spatial virtual position is altered, timbre and loudness artefacts can occur for encodings of two-channel stereo to Higher Order Ambisonics (denoted HOA) using the speaker positions as plane wave origins.

In the context of spatial audio, while both audio image sharpness and spaciousness may be desirable, the two may have contradictory requirements. Sharpness allows an audience to clearly identify directions of audio sources, while spaciousness enhances a listener's feeling of envelopment.

The present disclosure is directed to maintaining both sharpness and spaciousness after converting two-channel stereo channel based content to 3D audio scene/object based audio content.

A primary ambient decomposition (PAD) may separate directional and ambient components found in channel based audio. The directional component is an audio signal related to a source direction. This directional component may be manipulated to determine a new directional component. The new directional component may be encoded to HOA, except for the centre channel direction where the related signal is handled as a static object channel. Additional ambient representations are derived from the ambient components. The additional ambient representations are encoded to HOA.

The encoded HOA directional and ambient components may be combined and an output of the combined HOA representation and the centre channel signal may be provided.

In one example, this processing may be represented as:

A) A two-channel stereo signal x(t) is partitioned into overlapping sample blocks. The partitioned signals are transformed into the time-frequency domain (T/F) using a filter-bank, such as, for example by means of an FFT. The transformation may determine T/F tiles.

B) In the T/F domain, direct and ambient signal components are separated from the two-channel stereo signal x(t) based on:

- B.1) Estimating ambient power $P_N(\hat{t},k)$, direct power $P_S(\hat{t},k)$, source directions $\varphi_s(\hat{t},k)$, and mixing coefficients a for the directional signal components to be extracted.
- B.2) Extracting: (i) two ambient T/F signal channels $n(\hat{t},k)$ and (ii) one directional signal component $s(\hat{t},k)$ for each T/F tile related to each estimated source direction $\varphi_s(\hat{t},k)$ from B.1.
- B.3) Manipulating the estimated source directions $\varphi_s(\hat{t},k)$ by a stage_width factor $s_W$.
  - B.3.a) If the manipulated directions related to the T/F tile components are within an interval of ±center_channel capture width factor $c_W$, they are combined in order to form a directional centre channel object signal $o_c(\hat{t},k)$ in the T/F domain.
  - B.3.b) For directions other than those in B.3.a), the directional T/F tiles are encoded to HOA using a spherical harmonic encoding vector $y_s(\hat{t},k)$ derived from the manipulated source directions, thus creating a directional HOA signal $b_s(\hat{t},k)$ in the T/F domain.
- B.4) Deriving additional ambient signal channels $\ddot{n}(\hat{t},k)$ by de-correlating the extracted ambient channels $n(\hat{t},k)$, rating these channels by gain factors $g_L$, and encoding all ambient channels to HOA by creating a spherical harmonics encoding matrix $\boldsymbol{\Psi}_{\ddot{n}}$ from predefined positions, and thus creating an ambient HOA signal $\boldsymbol{b}_{\ddot{n}}(\hat{t},k)$ in the T/F domain.

C) Creating a combined HOA signal $b(\hat{t},k)$ in T/F domain by combining the directional HOA signals $b_s(\hat{t},k)$ and the ambient HOA signals $\boldsymbol{b}_{\ddot{n}}(\hat{t},k)$.

D) Transforming this HOA signal $b(\hat{t},k)$ and the centre channel object signals $o_c(\hat{t},k)$ to time domain by using an inverse filter-bank.

E) Storing or transmitting the resulting time domain HOA signal b(t) and the centre channel object signal $o_c(t)$ using an MPEG-H 3D Audio data rate compression encoder.

A new format may utilize HOA for encoding spatial audio information plus a static object for encoding a centre channel. The new 3D audio scene/object content can be used when pimping up or upmixing legacy stereo content to 3D audio. The content may then be transmitted based on any MPEG-H compression and can be used for rendering to any loudspeaker setup.

In principle, the inventive method is adapted for generating 3D audio scene and object based content from two-channel stereo based content, and includes:

partitioning a two-channel stereo signal into overlapping sample blocks followed by a transform into time-frequency domain T/F;

separating direct and ambient signal components from said two-channel stereo signal in T/F domain by:

estimating ambient power, direct power, source directions $\varphi_s(\hat{t},k)$ and mixing coefficients for directional signal components to be extracted;

extracting two ambient T/F signal channels $n(\hat{t},k)$ and one directional signal component $s(\hat{t},k)$ for each T/F tile related to an estimated source direction $\varphi_s(\hat{t},k)$;

changing said estimated source directions by a predetermined factor, wherein, if said changed directions related to the T/F tile components are within a predetermined interval, they are combined in order to form a directional centre channel object signal $o_c(\hat{t},k)$ in T/F domain, and for the other changed directions outside of said interval, encoding the directional T/F tiles to Higher Order Ambisonics HOA using a spherical harmonic encoding vector derived from said changed source directions, thereby generating a directional HOA signal $b_s(\hat{t},k)$ in T/F domain;

generating additional ambient signal channels $\ddot{\boldsymbol{n}}(\hat{t},k)$ by de-correlating said extracted ambient channels $n(\hat{t},k)$ and rating these channels by gain factors, and encoding all ambient channels to HOA by generating a spherical harmonics encoding matrix from predefined positions, thereby generating an ambient HOA signal $\boldsymbol{b}_{\ddot{n}}(\hat{t},k)$ in T/F domain;

generating a combined HOA signal $b(\hat{t},k)$ in T/F domain by combining said directional HOA signals $b_s(\hat{t},k)$ and said ambient HOA signals $\boldsymbol{b}_{\ddot{n}}(\hat{t},k)$;

transforming said combined HOA signal $b(\hat{t},k)$ and said centre channel object signals $o_c(\hat{t},k)$ to time domain.

In principle the inventive apparatus is adapted for generating 3D audio scene and object based content from two-channel stereo based content, said apparatus including means adapted to:

partition a two-channel stereo signal into overlapping sample blocks followed by transform into time-frequency domain T/F;

separate direct and ambient signal components from said two-channel stereo signal in T/F domain by:

estimating ambient power, direct power, source directions $\varphi_s(\hat{t},k)$ and mixing coefficients for directional signal components to be extracted;

extracting two ambient T/F signal channels $n(\hat{t},k)$ and one directional signal component $s(\hat{t},k)$ for each T/F tile related to an estimated source direction $\varphi_s(\hat{t},k)$;

changing said estimated source directions by a predetermined factor, wherein, if said changed directions related to the T/F tile components are within a predetermined interval, they are combined in order to form a directional centre channel object signal $o_c(\hat{t},k)$ in T/F domain, and for the other changed directions outside of said interval, encoding the directional T/F tiles to Higher Order Ambisonics HOA using a spherical harmonic encoding vector derived from said changed source directions, thereby generating a directional HOA signal $b_s(\hat{t},k)$ in T/F domain;

generating additional ambient signal channels $\ddot{\boldsymbol{n}}(\hat{t},k)$ by de-correlating said extracted ambient channels $n(\hat{t},k)$ and rating these channels by gain factors, and encoding all ambient channels to HOA by generating a spherical harmonics encoding matrix from predefined positions, thereby generating an ambient HOA signal $\boldsymbol{b}_{\ddot{n}}(\hat{t},k)$ in T/F domain;

generate (11, 31) a combined HOA signal $b(\hat{t},k)$ in T/F domain by combining said directional HOA signals $b_s(\hat{t},k)$ and said ambient HOA signals $\boldsymbol{b}_{\ddot{n}}(\hat{t},k)$;

transform (11, 31) said combined HOA signal $b(\hat{t},k)$ and said centre channel object signals $o_c(\hat{t},k)$ to time domain.

In principle, the inventive method is adapted for generating 3D audio scene and object based content from two-channel stereo based content, and includes: receiving the two-channel stereo based content represented by a plurality of time/frequency (T/F) tiles; determining, for each tile, ambient power, direct power, source directions $\varphi_s(\hat{t},k)$ and mixing coefficients; determining, for each tile, a directional signal and two ambient T/F channels based on the corresponding ambient power, direct power, and mixing coefficients;

determining the 3D audio scene and object based content based on the directional signal and ambient T/F channels of the T/F tiles. The method may further include wherein, for each tile, a new source direction is determined based on the source direction $\varphi_s(\hat{t},k)$, and, based on a determination that the new source direction is within a predetermined interval, a directional centre channel object signal $o_c(\hat{t},k)$ is determined based on the directional signal, the directional centre channel object signal $o_c(\hat{t},k)$ corresponding to the object based content, and, based on a determination that the new source direction is outside the predetermined interval, a directional HOA signal $b_s(\hat{t},k)$ is determined based on the new source direction. Moreover, for each tile, additional ambient signal channels $\ddot{\boldsymbol{n}}(\hat{t},k)$ may be determined based on a de-correlation of the two ambient T/F channels, and ambient HOA signals $\boldsymbol{b}_{\ddot{n}}(\hat{t},k)$ are determined based on the additional ambient signal channels. The 3D audio scene content is based on the directional HOA signals $b_s(\hat{t},k)$ and the ambient HOA signals $\boldsymbol{b}_{\ddot{n}}(\hat{t},k)$.

BRIEF DESCRIPTION OF DRAWINGS

Exemplary embodiments of the invention are described with reference to the accompanying drawings, which show in.

DESCRIPTION OF EMBODIMENTS

Even if not explicitly described, the following embodiments may be employed in any combination or sub-combination.

Figure 1:
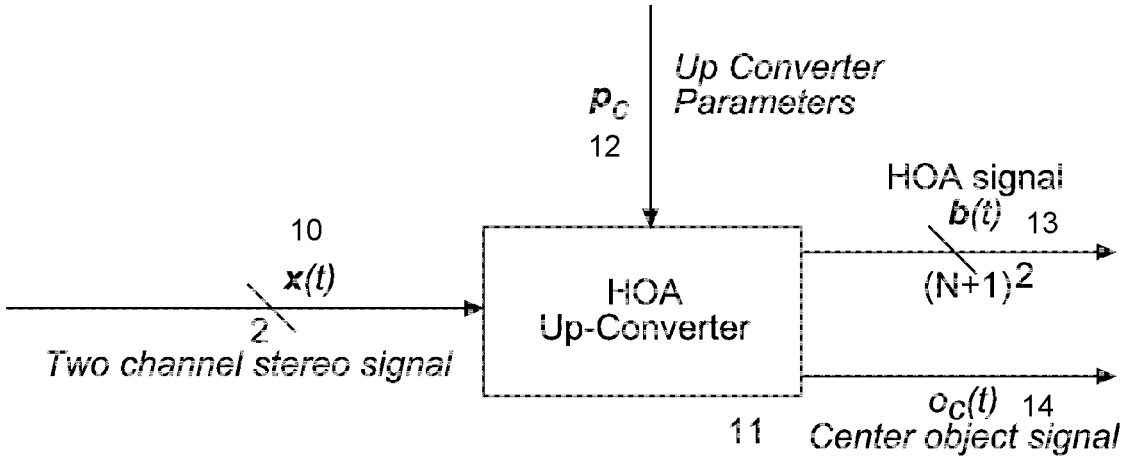
FIG. 1 illustrates an exemplary HOA upconverter.

FIG. 1 illustrates an exemplary HOA upconverter 11. The HOA upconverter 11 may receive a two-channel stereo signal x(t) 10. The two-channel stereo signal 10 is provided to an HOA upconverter 11. The HOA upconverter 11 may further receive an input parameter set vector $p_c$ 12. The HOA upconverter 11 then determines a HOA signal b(t) 13 having $(N+1)^2$ coefficient sequences for encoding spatial audio information and a centre channel object signal $o_c(t)$ for encoding a static object. In one example, HOA upconverter 11 may be implemented as part of a computing device that is adapted to perform the processing carried out by each of said respective units.

Figure 2:
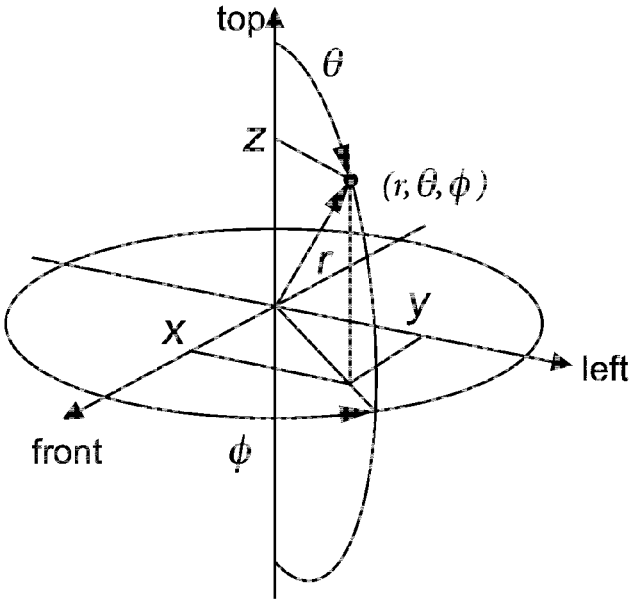
FIG. 2 illustrates Spherical and Cartesian reference coordinate system.

FIG. 2 shows a spherical coordinate system, in which the x axis points to the frontal position, the y axis points to the left, and the z axis points to the top. A position in space $x=(r,\theta,\phi)^T$ is represented by a radius r>0 (i.e. the distance to the coordinate origin), an inclination angle $\theta\in[0,\pi]$ measured from the polar axis z and an azimuth angle $\phi\in[0,2\pi[$ measured counter-clockwise in the x-y plane from the x axis. $(\bullet)^T$ denotes a transposition. The sound pressure is expressed in HOA as a function of these spherical coordinates and spatial frequency $$k = \frac{\omega}{c} = \frac{2\pi f}{c},$$

wherein c is the speed of sound waves in air.

The following definitions are used in this application (see also FIG. 2). Bold lowercase letters indicate a vector and bold uppercase letters indicate a matrix. For brevity, discrete time and frequency indices $t,\hat{t},k$ are often omitted if allowed by the context.

TABLE 1

| | | |
|---|---|---|
| 1. $\mathbf{x}(t)$ | Input two-channel stereo signal, $\mathbf{x}(t) = [x_1(t), x_2(t)]^T$, where **t** indicates a sample value related to the sampling frequency fs | $\mathbf{x} \in \mathbb{R}^2$ |
| 2. $\mathbf{b}(t)$ | Output HOA signal with HOA order N $\mathbf{b}(t) = [b_1(t), \ldots, b_{(N+1)^2}(t)]^T = [b_0^0(t), b_1^{-1} \ldots, b_N^N(t)]$ | $\mathbf{b} \in \mathbb{R}^{(N+1)^2}$ |
| 3. $o_c(t)$ | Output centre channel object signal | $o_c \in \mathbb{R}^1$ |
| 4. $\mathbf{p}_c$ | Input parameter vector with control values: stage_width $\mathcal{S}_W$, center_channel_capture_width $c_W$, maximum HOA order index N, ambient gains $\mathbf{g}_L \in \mathbb{R}^L$, direct_sound_encoding_elevation $\theta_S$ | |
| 5. $\hat{\Omega}$ | A spherical position vector according to FIG. 2. $\hat{\Omega} = [r, \theta, \phi]$ with radius **r**, inclination θ and azimuth **φ** | |
| 6. $\Omega$ | Spherical direction vector $\hat{\Omega} = [\theta, \phi]$ | |
| 7. $\varphi_x$ | Ideal loudspeaker position azimuth angle related to signal $x_1$, assuming that $-\varphi_x$ is the position related to $x_2$ | |
| 8. | T/F Domain variables: | |
| 9. $\mathbf{x}(\hat{t}, k)$ $\mathbf{b}(\hat{t}, k)$ $o_c(\hat{t}, k)$ | Input and output signals in complex T/F domain, where $\hat{t}$ indicates the discrete temporal index and k the discrete frequency index | $\mathbf{x} \in \mathbb{C}^2$ $\mathbf{b} \in \mathbb{C}^{(N+1)^2}$ $o_c \in \mathbb{C}^1$ |
| 10. $s(\hat{t}, k)$ | Extracted directional signal component | $s \in \mathbb{C}^1$ |
| 11. $\mathbf{a}(\hat{t}, k)$ | Gain vector that mixes the directional components into $\mathbf{x}(\hat{t}, k)$, $\mathbf{a} = [a_1, a_2]^T$ | $\mathbf{a} \in \mathbb{R}^2$ |
| 12. $\varphi_s(\hat{t}, k)$ | Azimuth angle of virtual source direction of $\mathbf{s}(\hat{t}, k)$ | $\varphi_s \in \mathbb{R}^1$ |
| 13. $\mathbf{n}(\hat{t}, k)$ | Extracted ambient signal components, $\mathbf{n} = [n_1, n_2]^T$ | $\mathbf{n} \in \mathbb{C}^2$ |
| 14. $P_S(\hat{t}, k)$ | Estimated power of directional component | |
| 15. $P_N(\hat{t}, k)$ | Estimated power of ambient components $n_1$, $n_2$ | |
| 16. $\mathbf{C}(\hat{t}, k)$ | Correlation/covariance matrix, $\mathbf{C}(\hat{t}, k) = E(\mathbf{x}(\hat{t}, k)\, \mathbf{x}(\hat{t}, k)^H)$, with $\mathbf{E}(\,)$ denoting the expectation operator | $\mathbf{C} \in \mathbb{C}^{2\times 2}$ |
| 17. $\ddot{\boldsymbol{n}}(\hat{t}, k)$ | Ambient component vector consisting of **L** ambience channels | $\ddot{\boldsymbol{n}} \in \mathbb{C}^L$ |
| 18. $\mathbf{y}_s(\hat{t}, k)$ | Spherical harmonics vector $\mathbf{y}_s = [Y_0^0(\theta_S, \phi_s), Y_1^{-1}(\theta_S, \phi_s), \ldots, Y_N^N(\theta_S, \phi_s)]^T$ to encode s to HOA, where $\theta_S$, $\phi_s$ is the encoding direction of the directional component, $\phi_s = \mathcal{S}_W \varphi_s$ | $\mathbf{y}_s$ |

TABLE 1-continued

| | | |
|---|---|---|
| 19. $Y_n^m(\theta, \phi)$ | Spherical Harmonic (SH) of order **n** and degree **m**. See [1] and section HOA format description for details. All considerations are valid for N3D normalised SHs. | $Y_n^m \in \mathbb{R}^{(N+1)^2}$ |
| 20. $\Psi_{\ddot{n}}$ | Mode matrix to encode the ambient component vector $\ddot{n}$ to HOA. $\Psi_{\ddot{n}} = [y_{\ddot{n}1}, \ldots, y_{\ddot{n}L}]$, $y_{\ddot{n}L} = [Y_0^0(\theta_L, \phi_L), Y_1^{-1}(\theta_L, \phi_L), \ldots, Y_N^N(\theta_L, \phi_L)]^T$ | $\Psi_L \in \mathbb{R}^{(N+1)^2 x L}$ |
| 21. $b_s(\hat{t}, k)$ | Directional HOA component | |
| $b_{\ddot{n}}(\hat{t}, k)$ | Diffuse HOA component | |

Initialization

In one example, an initialisation may include providing to or receiving by a method or a device a channel stereo signal x(t) and control parameters $p_c$ (e.g., the two-channel stereo signal x(t) 10 and the input parameter set vector $p_c$ 12 illustrated in FIG. 1). The parameter $p_c$ may include one or more of the following elements:

- stage_width $s_W$ element that represents a factor for manipulating source directions of extracted directional sounds, (e.g., with a typical value range from 0.5 to 3);
- center_channel_capture_width $c_W$ element that relates to setting an interval (e.g., in degrees) in which extracted direct sounds will be re-rendered to a centre channel object signal; where a negative $c_W$ value (e.g. in the range 0 to 10 degrees) will defeat this channel and zero PCM values will be the output of $o_c(t)$; and a positive value of $c_W$ will mean that all direct sounds will be rendered to the centre channel if their manipulated source direction is in the interval $[-c_W, c_W]$.
- max HOA order index N element that defines the HOA order of the output HOA signal b(t) that will have $(N+1)^2$ HOA coefficient channels;
- ambient gains $g_L$ elements that relate to L values are used for rating the derived ambient signals $\ddot{n}(\hat{t},k)$ before HOA encoding; these gains (e.g. in the range 0 to 2) manipulate image sharpness and spaciousness;
- direct_sound_encoding_elevation $\theta_S$ element (e.g. in the range −10 to +30 degrees) that sets the virtual height when encoding direct sources to HOA.

The elements of parameter $p_c$ may be updated during operation of a system, for example by updating a smooth envelope of these elements or parameters.

Figure 3:
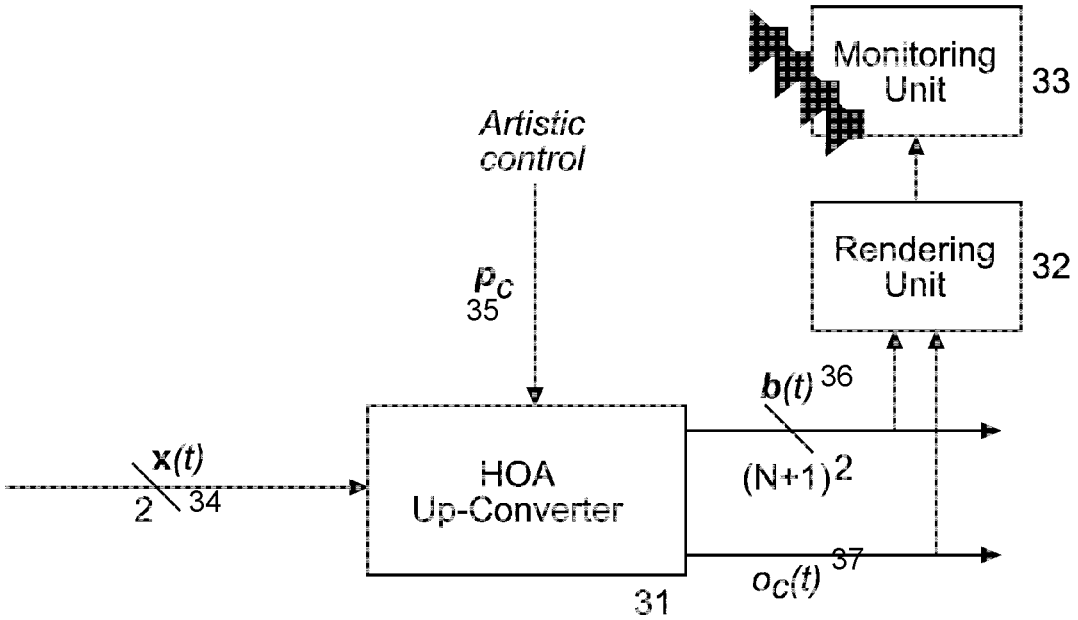
FIG. 3 illustrates an exemplary artistic interference HOA upconverter.

FIG. 3 illustrates an exemplary artistic interference HOA upconverter 31. The HOA upconverter 31 may receive a two-channel stereo signal x(t) 34 and an artistic control parameter set vector $p_c$ 35. The HOA upconverter 31 may determine an output HOA signal b(t) 36 having $(N+1)^2$ coefficient sequences and a centre channel object signal $o_c(t)$ 37 that are provided to a rendering unit 32, the output signal of which are being provided to a monitoring unit 33. In one example, the HOA upconverter 31 may be implemented as part of a computing device that is adapted to perform the processing carried out by each of said respective units.

T/F Analysis Filter Bank

A two channel stereo signal x(t) may be transformed by HOA upconverter 11 or 31 into the time/frequency (T/F) domain by a filter bank. In one embodiment a fast fourier transform (FFT) is used with 50% overlapping blocks of 4096 samples. Smaller frequency resolutions may be utilized, although there may be a trade-off between processing speed and separation performance. The transformed input signal may be denoted as $x(\hat{t},k)$ in T/F domain, where $\hat{t}$ relates to the processed block and k denotes the frequency band or bin index.

T/F Domain Signal Analysis

In one example, for each T/F tile of the input two-channel stereo signal x(t), a correlation matrix may be determined. In one example, the correlation matrix may be determined based on:

$$C(\hat{t}, k) = E(x(\hat{t}, k)x(\hat{t}, k)^H) = \begin{bmatrix} c_{11}(\hat{t}, k) & c_{12}(\hat{t}, k) \\ c_{21}(\hat{t}, k) & c_{22}(\hat{t}, k) \end{bmatrix}, \quad \text{Equation No. 1}$$

wherein E( ) denotes the expectation operator. The expectation can be determined based on a mean value over $t_{num}$ temporal T/F values (index $\hat{t}$) by using a ring buffer or an IIR smoothing filter.

The Eigenvalues of the correlation matrix may then be determined, such as for example based on:

$$\lambda_1(\hat{t}, k) = \frac{1}{2}\left(c_{22} + c_{11} + \sqrt{(c_{11} - c_{22})^2 + 4|c_{r12}|^2}\right) \quad \text{Equation No. 2a}$$

$$\lambda_2(\hat{t}, k) = \frac{1}{2}\left(c_{22} + c_{11} - \sqrt{(c_{11} - c_{22})^2 + 4|c_{r12}|^2}\right) \quad \text{Equation No. 2b}$$

wherein $c_{r12}$=real($c_{12}$) denotes the real part of $c_{12}$. The indices $(\hat{t},k)$ may be omitted during certain notations, e.g., as within Equation Nos. 2a and 2b.

For each tile, based on the correlation matrix, the following may be determined: ambient power, directional power, elements of a gain vector that mixes the directional components, and an azimuth angle of the virtual source direction $s(\hat{t},k)$ to be extracted.

In one example, the ambient power may be determined based on the second eigenvalue, such as for example:

$$P_N(\hat{t},k):P_N(\hat{t},k)=\lambda_2(\hat{t},k) \quad \text{Equation No. 3}$$

In another example, the directional power may be determined based on the first eigenvalue and the ambient power, such as for example:

$$P_s(\hat{t},k):P_s(\hat{t},k)=\lambda_1(\hat{t},k)-P_N(\hat{t},k) \quad \text{Equation No. 4}$$

In another example, elements of a gain vector $a(\hat{t},k)=[a_1(\hat{t},k), a_2(\hat{t},k)]^T$ that mixes the directional components into $x(\hat{t},k)$ may be determined based on:

$$a_1(\hat{t}, k) = \frac{1}{\sqrt{1 + A(\hat{t}, k)^2}}, \quad \text{Equation No. 5}$$

-continued $$a_2(\hat{t},k)=\frac{A(\hat{t},k)}{\sqrt{1+A(\hat{t},k)^2}},$$

with $$A(\hat{t},k)=\frac{\lambda_1(\hat{t},k)-c_{11}}{|c_{r12}|};\qquad \text{Equation No. 5a}$$

The azimuth angle of virtual source direction $s(\hat{t},k)$ to be extracted may be determined based on:

$$\varphi_s(\hat{t},k)=\left(\operatorname{atan}\left(\frac{1}{A(\hat{t},k)}\right)-\frac{\pi}{4}\right)\frac{\varphi_x}{(\pi/4)}\qquad \text{Equation No. 6}$$

with $\varphi_x$ giving the loudspeaker position azimuth angle related to signal $x_1$ in radian (assuming that $-\varphi_x$ is the position related to $x_2$).

Directional and Ambient Signal Extraction

In this sub section for better readability the indices $(\hat{t},k)$ are omitted. Processing is performed for each T/F tile $(\hat{t},k)$. For each T/F tile, a first directional intermediate signal is extracted based on a gain, such as, for example:

$$\hat{s}:=g^Tx\qquad \text{Equation No. 7a}$$

$$\text{with } g=\begin{bmatrix}\frac{a_1P_s}{P_s+P_N}\\ \frac{a_2P_s}{P_s+P_N}\end{bmatrix}\qquad \text{Equation No. 7b}$$

The intermediate signal may be scaled in order to derive the directional signal, such as for example, based on:

$$s=\sqrt{\frac{P_s}{(g_1a_1+g_2a_2)^2P_s+(g_1^2+g_2^2)P_N}}\,\hat{s}\qquad \text{Equation No. 8}$$

The two elements of an ambient signal $n=[n_1,n_2]^T$ are derived by first calculating intermediate values based on the ambient power, directional power, and the elements of the gain vector:

$$\hat{n}_1=h^Tx \text{ with } h=\begin{bmatrix}\frac{a_2^2P_s+P_N}{P_s+P_N}\\ \frac{-a_1a_2P_s}{P_s+P_N}\end{bmatrix}\qquad \text{Equation No. 9a}$$

$$\hat{n}_2=w^Tx \text{ with } w=\begin{bmatrix}\frac{-a_1a_2P_s}{P_s+P_N}\\ \frac{a_1^2P_s+P_N}{P_s+P_N}\end{bmatrix}\qquad \text{Equation No. 9b}$$

followed by scaling of these values:

$$n_1=\sqrt{\frac{P_N}{(h_1a_1+h_2a_2)^2P_s+(h_1^2+h_2^2)P_N}}\,\hat{n}_1\qquad \text{Equation No. 10a}$$

$$n_2=\sqrt{\frac{P_N}{(w_1a_1+w_2a_2)^2P_s+(w_1^2+w_2^2)P_N}}\,\hat{n}_2\qquad \text{Equation No. 10b}$$

Processing of Directional Components

A new source direction $\phi_s(\hat{t},k)$ may be determined based on a stage_width $s_W$ and, for example, the azimuth angle of the virtual source direction (e.g., as described in connection with Equation No. 6). The new source direction may be determined based on:

$$\phi_s(\hat{t},k)=s_W\varphi_s(\hat{t},k)\qquad \text{Equation No. 11}$$

A centre channel object signal $o_c(\hat{t},k)$ and/or a directional HOA signal $b_s(\hat{t},k)$ in the T/F domain may be determined based on the new source direction. In particular, the new source direction $\phi_s(\hat{t},k)$ may be compared to a center_channel_capture_width $c_W$. If $|\phi_s(\hat{t},k)|<c_W$, then $$o_c(\hat{t},k)=s(\hat{t},k) \text{ and } b_s(\hat{t},k)=0\qquad \text{Equation No. 12a}$$

else:

$$o_c(\hat{t},k)=0 \text{ and } b_s(\hat{t},k)=y_s(\hat{t},k)s(\hat{t},k)\qquad \text{Equation No. 12b}$$

where $y_s(\hat{t},k)$ is the spherical harmonic encoding vector derived from $\hat{\varphi}_s(\hat{t},k)$ and a direct sound encoding elevation $\theta_S$. In one example, the $y_s(\hat{t},k)$ vector may be determined based on the following:

$$y_s(\hat{t},k)=[Y_0^0(\theta_S,\phi_s),Y_1^{-1}(\theta_S,\phi_s),\ldots,Y_N^N(\theta_S,\phi_s)]^T\qquad \text{Equation No. 13}$$

Processing of Ambient HOA Signal

The ambient HOA signal $\boldsymbol{b}_{\ddot{n}}(\hat{t},k)$ may be determined based on the additional ambient signal channels $\ddot{\boldsymbol{n}}(\hat{t},k)$. For example, the ambient HOA signal $\boldsymbol{b}_{\ddot{n}}(\hat{t},k)$ may be determined based on:

$$\boldsymbol{b}_{\ddot{n}}(\hat{t},k)=\boldsymbol{\Psi}_{\ddot{n}}\operatorname{diag}(g_L)\,\ddot{\boldsymbol{n}}(\hat{t},k)\qquad \text{Equation No. 14}$$

where $\operatorname{diag}(g_L)$ is a square diagonal matrix with ambient gains $g_L$ on its main diagonal, $\ddot{\boldsymbol{n}}(\hat{t},k)$ is a vector of ambient signals derived from n and $\boldsymbol{\Psi}_{\ddot{n}}$ is a mode matrix for encoding $\ddot{\boldsymbol{n}}(\hat{t},k)$ to HOA. The mode matrix may be determined based on:

$$\boldsymbol{\Psi}_{\ddot{n}}=[\boldsymbol{y}_{\ddot{n}1},\ldots,\boldsymbol{y}_{\ddot{n}L}],\ \boldsymbol{y}_{\ddot{n}L}=[Y_0^0(\theta_L,\phi_L),Y_1^{-1}(\theta_L,\phi_L),\ldots,Y_N^N,(\theta_L,\phi_L)]^T\qquad \text{Eq No. 15}$$

wherein, L denotes the number of components in $\ddot{\boldsymbol{n}}(\hat{t},k)$.

In one embodiment L=6 is selected with the following positions:

TABLE 2

| l (direction number, ambient channel number) | $\theta_l$ Inclination/rad | $\phi_l$ Azimuth/rad |
|---|---|---|
| 1 | $\pi/2$ | $30\ \pi/180$ |
| 2 | $\pi/2$ | $-30\ \pi/180$ |
| 3 | $\pi/2$ | $105\ \pi/180$ |
| 4 | $\pi/2$ | $-105\ \pi/180$ |
| 5 | $\pi/2$ | $180\ \pi/180$ |
| 6 | 0 | 0 |

The vector of ambient signals is determined based on:

$$\ddot{n}(\hat{t}, k) = \begin{bmatrix} 1 & 0 \\ 0 & 1 \\ F_s(k) & 0 \\ 0 & F_s(k) \\ F_B(k) & F_B(k) \\ F_T(k) & F_T(k) \end{bmatrix} n \quad \text{Equation No. 16}$$

with weighting (filtering) factors $F_i(k) \in \mathbb{C}^1$, wherein $$F_i(k) = a_i(k) e^{-2\pi i k \frac{d_i}{DFT_{size}}},\ d_i,\ a_i(k) \in \mathbb{R}, \quad \text{Equation No. 17}$$

$d_i$ is a delay in samples, and $a_i(k)$ is a spectral weighting factor (e.g. in the range 0 to 1).

Synthesis Filter Bank

The combined HOA signal is determined based on the directional HOA signal $b_s(\hat{t},k)$ and the ambient HOA signal $\boldsymbol{b}_{\ddot{n}}(\hat{t},k)$. For example:

$$b(\hat{t},k) = b_s(\hat{t},k) + \boldsymbol{b}_{\ddot{n}}(\hat{t},k) \quad \text{Equation No. 18}$$

The T/F signals $b(\hat{t},k)$ and $o_c(\hat{t},k)$ are transformed back to time domain by an inverse filter bank to derive signals b(t) and $o_c(t)$. For example, the T/F signals may be transformed based on an inverse fast fourier transform (IFFT) and an overlap-add procedure using a sine window.

Processing of Upmixed Signals

The signals b(t) and $o_c(t)$ and related metadata, the maximum HOA order index N and the direction $$\Omega_{o_c} = \left[\frac{\pi}{2}, 0\right]$$

of signal $o_c(t)$ may be stored or transmitted based on any format, including a standardized format such as an MPEG-H 3D audio compression codec. These can then be rendered to individual loudspeaker setups on demand.

Primary Ambient Decomposition in T/F Domain

In this section the detailed deduction of the PAD algorithm is presented, including the assumptions about the nature of the signals. Because all considerations take place in T/F domain indices $(\hat{t},k)$ are omitted.

Signal Model, Model Assumptions and Covariance Matrix

The following signal model in time frequency domain (T/F) is assumed:

$$x = as + n, \quad \text{Equation No. 19a}$$

$$x_1 = a_1 s + n_1, \quad \text{Equation No. 19b}$$

$$x_2 = a_2 s + n_2, \quad \text{Equation No. 19c}$$

$$\sqrt{a_1^2 + a_2^2} = 1 \quad \text{Equation No. 19d}$$

The covariance matrix becomes the correlation matrix if signals with zero mean are assumed, which is a common assumption related to audio signals:

$$C = E(xx^H) = \begin{bmatrix} c_{11} & c_{12} \\ c_{12}^* & c_{22} \end{bmatrix} \quad \text{Equation No. 20}$$

wherein E( ) is the expectation operator which can be approximated by deriving the mean value over T/F tiles.

Next the Eigenvalues of the covariance matrix are derived. They are defined by $$\lambda_{1,2}(C) = \{x : \det(C - xI) = 0\}. \quad \text{Equation No. 21}$$

Applied to the covariance matrix:

$$\det\left(\begin{bmatrix} c_{11} - x & c_{12} \\ c_{12}^* & c_{22} - x \end{bmatrix}\right) = (c_{11} - x)(c_{22} - x) - |c_{12}|^2 = 0 \quad \text{Equation No. 22}$$

with $c_{12}^* c_{12} = |c_{12}|^2$.

The solution of $\lambda_{1,2}$ is:

$$\lambda_{1,2} = \frac{1}{2}\left(c_{22} + c_{11} \pm \sqrt{(c_{11} - c_{22})^2 + 4|c_{12}|^2}\right) \quad \text{Equation No. 23}$$

The model assumptions and the covariance matrix are given by:

Direct and noise signals are not correlated $E(sn_{1,2}^*) = 0$

The power estimate is given by $P_s = E(ss^*)$

The ambient (noise) component power estimates are equal:

$$P_N = P_{n_1} = P_{n_2} = E(n_1 n_1)$$

The ambient components are not correlated: $E(n_1 n_2^*) = 0$

The model covariance becomes $$C = \begin{bmatrix} |a_1|^2 P_s + P_N & a_1 a_2^* P_s \\ a_1^* a_2 P_s & |a_2|^2 P_s + P_N \end{bmatrix} \quad \text{Equation No. 24}$$

In the following real positive-valued mixing coefficients $a_1$, $a_2$ and $\sqrt{a_1^2 + a_2^2} = 1$ are assumed, and consequently $c_{r12} = \text{real}(c_{12})$. The Eigenvalues become:

$$\lambda_{1,2} = \frac{1}{2}\left(c_{22} + c_{11} \pm \sqrt{(c_{11} - c_{22})^2 + 4|c_{r12}|^2}\right) \quad \text{Equation No. 25a}$$

$$= 0.5\left(P_s + 2P_N \pm \sqrt{(P_s^2(a_1^2 - a_2^2)^2 + 4a_1^2 a_2^2 P_s)}\right) \quad \text{Equation No. 25b}$$

$$= 0.5\left(P_s + 2P_N \pm \sqrt{(P_s^2(a_1^2 + a_2^2)^2)}\right) \quad \text{Equation No. 25c}$$

$$= 0.5(P_s + 2P_N \pm P_s) \quad \text{Equation No. 25d}$$

Estimates of Ambient Power and Directional Power

The ambient power estimate becomes:

$$P_N = \lambda_2 = \frac{1}{2}\left(c_{22} + c_{11} - \sqrt{(c_{11} - c_{22})^2 + 4|c_{r12}|^2}\right) \quad \text{Equation No. 26}$$

The direct sound power estimate becomes:

$$P_S = \lambda_1 - P_N = \sqrt{(c_{11} - c_{22})^2 + 4|c_{r12}|^2} \quad \text{Equation No. 27}$$

Direction of Directional Signal Component

The ratio A of the mixing gains can be derived as:

$$A = \frac{a_2}{a_1} = \frac{\lambda_1 - c_{11}}{|c_{r12}|} = \frac{P_N + P_s - c_{11}}{|c_{r12}|} = \quad \text{Eq. No. 28}$$

-continued $$\frac{c_{22}-P_N}{|c_{r12}|}=\frac{\left(c_{22}-c_{11}+\sqrt{(c_{11}-c_{22})^2+4|c_{r12}|^2}\right)}{2|c_{r12}|}$$

with $a_1^2=1-a_2^2$, and $a_2^2=1-a_1^2$ it follows:

$$a_1=\frac{1}{\sqrt{1+A^2}}\text{ and }a_2=\frac{A}{\sqrt{1+A^2}}$$

The principal component approach includes:

The first and second Eigenvalues are related to Eigenvectors $v_1,v_2$ which are given in mathematical literature and in [8] by $$V=[v_1,v_2]=\begin{bmatrix}\cos(\hat{\varphi}) & -\sin(\hat{\varphi})\\ \sin(\hat{\varphi}) & \cos(\hat{\varphi})\end{bmatrix}\quad\text{Equation No. 29}$$

Here the signal $x_1$ would relate to the x-axis and the signal $x_2$ would relate to the y-axis of a Cartesian coordinate system. This would map the two channels to be 90° apart with relations: $\cos(\hat{\varphi})=a_1s/s$, $\sin(\hat{\varphi})=a_2s/s$. Thus the ratio of the mixing gains can be used to derive $\hat{\varphi}$, with:

$$A=\frac{a_2}{a_1}:\ \hat{\varphi}=\text{atan}(A)\quad\text{Equation No. 30}$$

The preferred azimuth measure $\varphi$ would refer to an azimuth of zero placed half angle between related virtual speaker channels, positive angle direction in mathematical sense counter clock wise. To translate from the above-mentioned system:

$$\varphi=-\hat{\varphi}+\frac{\pi}{4}=-\text{atan}(A)+\frac{\pi}{4}=\text{atan}(1/A)-\pi/4\quad\text{Equation No. 31}$$

The tangent law of energy panning is defined as $$\frac{\tan(\varphi)}{\tan(\varphi_o)}=\frac{a_1-a_2}{a_1+a_2}\quad\text{Equation No. 32}$$

where $\varphi_o$ is the half loudspeaker spacing angle. In the model used here, $$\varphi_o=\frac{\pi}{4},\ \tan(\varphi_o)=1.$$

It can be shown that $$\varphi=\text{atan}\left(\frac{a_1-a_2}{a_1+a_2}\right)\quad\text{Equation No. 33}$$

Figure 4:
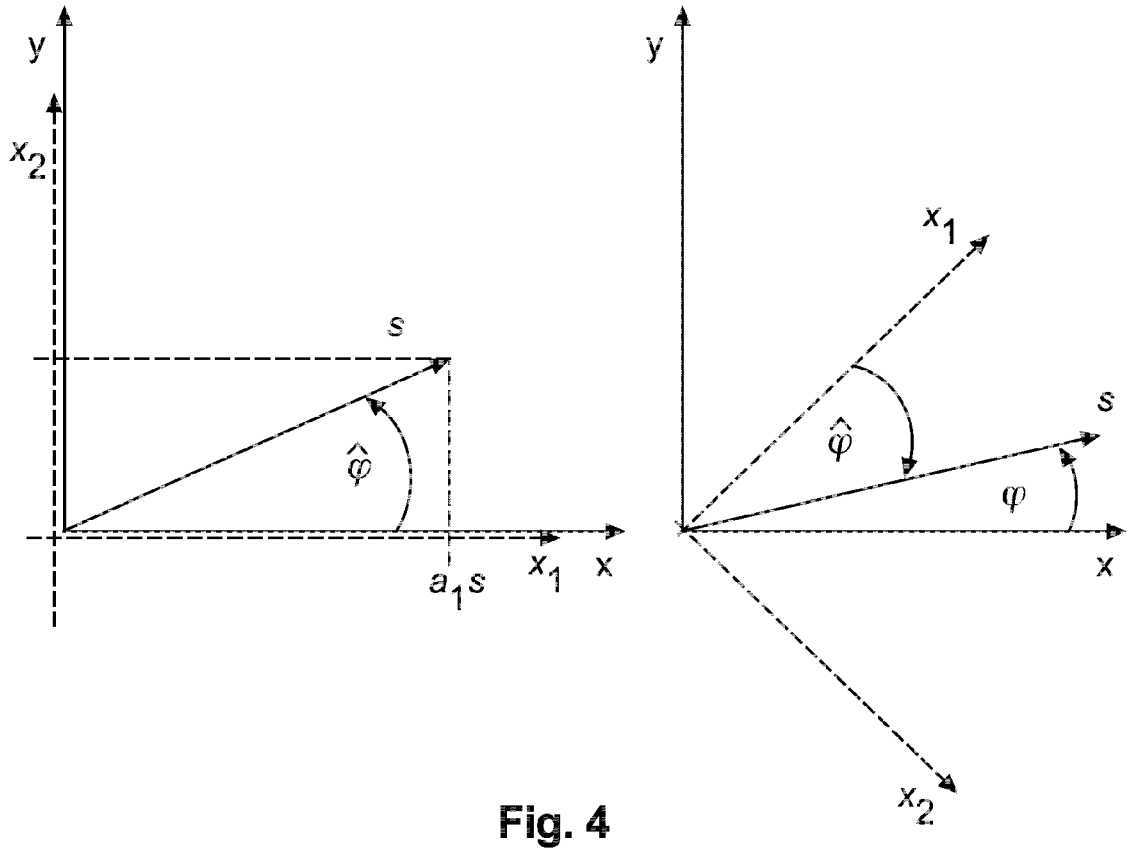
FIG. 4 illustrates classical PCA coordinates system (left) and intended coordinate system (right) that complies with FIG. 2.

Based on FIG. 2, FIG. 4*a* illustrates a classical PCA coordinates system. FIG. 4*b* illustrates an intended coordinate system.

Mapping the angle $\varphi$ to a real loudspeaker spacing includes: Other speaker $\varphi_x$ spacings than the 90°

$$\left(\varphi_o=\frac{\pi}{4}\right)$$

addressed in the model can be addressed based on either:

$$\varphi_s=\varphi\frac{\varphi_x}{\varphi_o}\quad\text{Equation No. 34a}$$

or more accurate $$\hat{\varphi}_s=\text{atan}\left(\tan(\varphi_x)\frac{a_1-a_2}{a_1+a_2}\right)\quad\text{Equation No. 34b}$$

Figure 5:
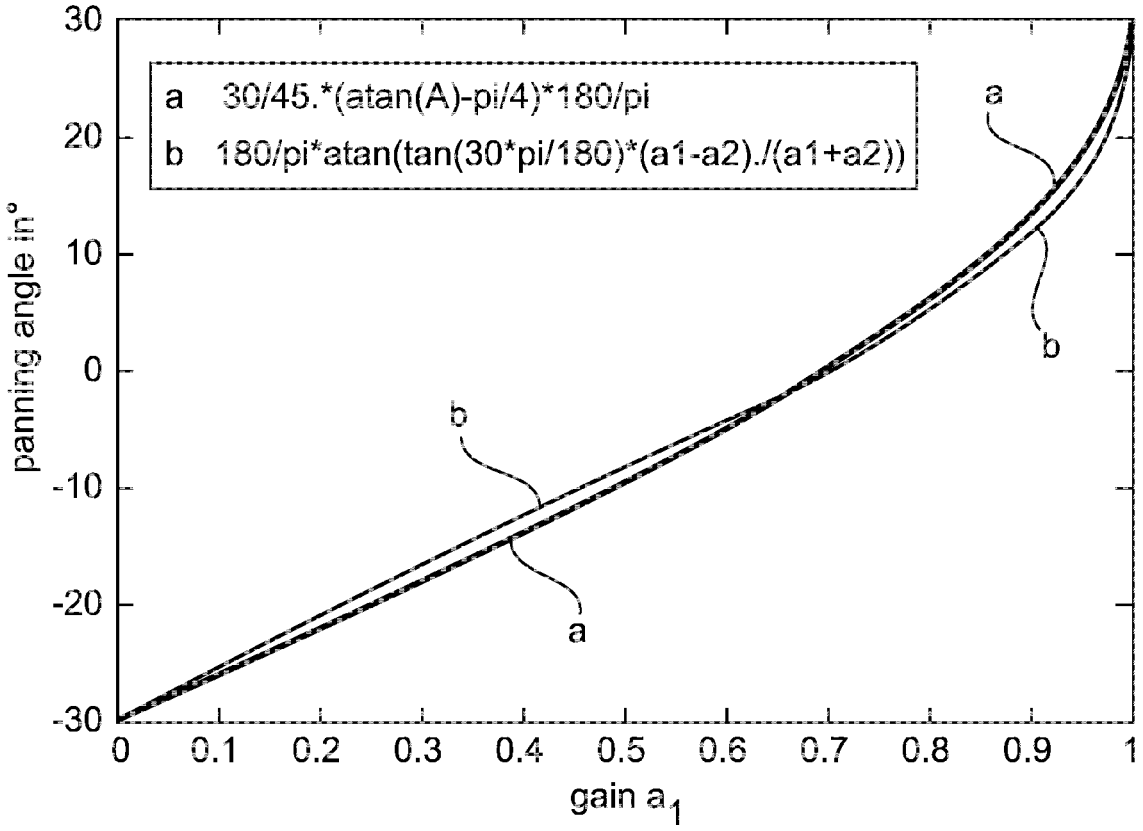
FIG. 5 illustrates comparison of extracted azimuth source directions using the simplified method and the tangent method.

FIG. 5 illustrates two curves, a and b, that relate to a difference between both methods for a 60° loudspeaker spacing $$\left(\varphi_x=30°\frac{\pi}{180°}\right).$$

To encode the directional signal to HOA with limited order, the accuracy of the first method $$\left(\varphi_s=\varphi\frac{\varphi_x}{\varphi_o}\right)$$

is regarded as being sufficient.

Directional and Ambient Signal Extraction

Directional Signal Extraction

The directional signal is extracted as a linear combination with gains $g^T=[g_1,g_2]$ of the input signals:

$$\hat{s}:=g^Tx=g^T(as+n)\quad\text{Equation No. 35a}$$

The error signal is $$\text{err}=s-g^T(as+n)\quad\text{Equation No. 35b}$$

and becomes minimal if fully orthogonal to the input signals x with $\hat{s}=s$:

$$E(x\text{err}^*)=0\quad\text{Equation No. 36}$$

$$aP_{\hat{s}}ag^TaP_{\hat{s}}+gP_n=0\quad\text{Equation No. 37}$$

taking in mind the model assumptions that the ambient components are not correlated:

$$(E(n_1n_2^*)=0)\quad\text{Equation No. 38}$$

Because the order of calculation of a vector product of the form $g^Ta$ is interchangeable, $g^Ta=ag^T$:

$$(aa^TP_{\hat{s}}+IP_N)g=aP_{\hat{s}}\quad\text{Equation No. 39}$$

The term in brackets is a quadratic matrix and a solution exists if this matrix is invertible, and by first setting $P_{\hat{s}}=P_s$ the mixing gains become:

$$g=(aa^TP_{\hat{s}}+IP_N)^{-1}aP_{\hat{s}}\quad\text{Equation No. 40a}$$

$$(aa^TP_{\hat{s}}+IP_N)=\begin{bmatrix}a_1^2P_{\hat{s}}+P_N & a_1a_2P_{\hat{s}}\\ a_1a_2P_{\hat{s}} & a_2^2P_{\hat{s}}+P_N\end{bmatrix}\quad\text{Equation No. 40b}$$

Solving this System Leads to:

$$g = \begin{bmatrix} \frac{a_1 P_s}{P_s + P_N} \\ \frac{a_2 P_s}{P_s + P_N} \end{bmatrix} \quad \text{Equation No. 41}$$

Post-Scaling:

The solution is scaled such that the power of the estimate $\hat{s}$ becomes $P_s$, with $$P_{\hat{s}} = E(\hat{s}\hat{s}^*) = g^T(aa^T P_s + IP_N)g \quad \text{Equation No. 42a}$$

$$s = \sqrt{\frac{P_s}{g^T(aa^T P_s + IP_N)g}}\,\hat{s} = \sqrt{\frac{P_s}{(g_1 a_1 + g_2 a_2)^2 P_s + (g_1^2 + g_2^2)P_N}}\,\hat{s} \quad \text{Equation No. 42b}$$

Extraction of Ambient Signals

The unscaled first ambient signal can be derived by subtracting the unscaled directional signal component from the first input channel signal:

$$\hat{n}_1 = x_1 - a_1\hat{s} = x_1 - a_1 g^T x := h^T x \quad \text{Equation No. 43}$$

Solving this for $\hat{n}_1 = h^T x$ leads to $$h = \begin{bmatrix} 1 \\ 0 \end{bmatrix} - a_1 g = \begin{bmatrix} \frac{a_2^2 P_s + P_N}{P_s + P_N} \\ \frac{-a_1 a_2 P_s}{P_s + P_N} \end{bmatrix} \quad \text{Equation No. 44}$$

The solution is scaled such that the power of the estimate $\hat{n}_1$ becomes $P_N$, with $$P_{\hat{n}_1} = E(\hat{n}_1\hat{n}_1^*) = h^T E(xx^H)h = h^T(aa^T P_s + IP_N)h: \quad \text{Equation No. 42a}$$

$$n_1 = \sqrt{\frac{P_N}{(h_1 a_1 + h_2 a_2)^2 P_s + (h_1^2 + h_2^2)P_N}}\,\hat{n}_1 \quad \text{Equation No. 42b}$$

The unscaled second ambient signal can be derived by subtracting the rated directional signal component from the second input channel signal $$\hat{n}_2 = x_2 - a_2\hat{s} = x_2 - a_2 g^T x := w^T X \quad \text{Equation No. 46}$$

Solving this for $\hat{n}_2 = w^T X$ leads to $$w = \begin{bmatrix} 0 \\ 1 \end{bmatrix} - a_2 g = \begin{bmatrix} \frac{-a_1 a_2 P_s}{P_s + P_n} \\ \frac{a_1^2 P_s + P_n}{P_s + P_n} \end{bmatrix} \quad \text{Equation No. 47}$$

The solution is scaled such that the power $P_{\hat{n}}$ of the estimate $\hat{n}_2$ becomes $P_N$, with $$P_{\hat{n}_2} = E(\hat{n}_2\hat{n}_2^*) = w^T E(xx^H)w = w^T(aa^T P_s + IP_N)w \quad \text{Equation No. 48a}$$

-continued $$n_2 = \sqrt{\frac{P_N}{(w_1 a_1 + w_2 a_2)^2 P_s + (w_1^2 + w_2^2)P_N}}\,\hat{n}_2 \quad \text{Equation No. 48b}$$

Encoding Channel Based Audio to HOA

Naive Approach

Using the covariance matrix, the channel power estimate of x can be expressed by:

$$P_x = tr(C) = tr(E(xx^H)) = E(tr(xx^H)) = E(tr(x^H x)) = E(x^H x) \quad \text{Eq No. 49}$$

with E( ) representing the expectation and tr( ) representing the trace operators.

When returning to the signal model from section Primary ambient decomposition in T/F domain and the related model assumptions in T/F domain:

$$x = as + n, \quad \text{Equation No. 50a}$$

$$x_1 = a_1 s + n_1, \quad \text{Equation No. 50b}$$

$$x_2 = a_2 s + n_2, \quad \text{Equation No. 50c}$$

$$\sqrt{a_1^2 + a_2^2} = 1, \quad \text{Equation No. 50d}$$

the channel power estimate of x can be expressed by:

$$P_x = E(x^H x) = P_s + {}^2 P_N \quad \text{Equation No. 51}$$

The value of $P_x$ may be proportional to the perceived signal loudness. A perfect remix of x should preserve loudness and lead to the same estimate.

During HOA encoding, e.g., by a mode-matrix $Y(\Omega_x)$, the spherical harmonics values may be determined from directions $\Omega_x$ of the virtual speaker positions:

$$b_{x1} = Y(\Omega_x)x \quad \text{Equation No. 52}$$

HOA rendering with rendering matrix D with near energy preserving features (e.g., see section 12.4.3 of Reference [1]) may be determined based on:

$$D^H D \approx \frac{I}{(N+1)^2}, \quad \text{Equation No. 53}$$

where I is the unity matrix and $(N+1)^2$ is a scaling factor depending on HOA order N:

$$\check{x} = DY(\Omega_x)x \quad \text{Equation No. 54}$$

The signal power estimate of the rendered encoded HOA signal becomes:

$$P_{\check{x}} = E(x^H Y(\Omega_x)^H D^H D Y(\Omega_x)x) \quad \text{Equation No. 55a}$$

$$\approx E\left(\frac{1}{(N+1)^2} x^H Y(\Omega_x)^H Y(\Omega_x)x\right) = tr\left(CY(\Omega_x)^H Y(\Omega_x)\frac{1}{(N+1)^2}\right) \quad \text{Eq. No. 55b}$$

The following may be determined then:

$$P_{\check{x}} P_x, \quad \text{Equation No. 55c}$$

This may lead to:

$$Y(\Omega_x)^H Y(\Omega_x) := (N+1)^2 I, \quad \text{Equation No. 56}$$

which usually cannot be fulfilled for mode matrices related to arbitrary positions. The consequences of $Y(\Omega_x)^H Y(\Omega_x)$ not becoming diagonal are timbre colorations and loudness fluctuations. $Y(\Omega_{id})$ becomes a un-normalised unitary matrix only for special positions (directions) $\Omega_{id}$ where the number of positions (directions) is equal or bigger than $(N+1)^2$ and at the same time where the angular distance to next neighbour positions is constant for every position (i.e. a regular sampling on a sphere).

Regarding the impact of maintaining the intended signal directions when encoding channels based content to HOA and decoding:

Let x=a s, where the ambient parts are zero. Encoding to HOA and rendering leads to $\hat{x}=D\,Y(\Omega_x)a\,s$.

Only rendering matrices satisfying $D\,Y(\Omega_x)=I$ would lead to the same spatial impression as replaying the original. Generally, $D=Y(\Omega_x)^{-1}$ does not exist and using the pseudo inverse will in general not lead to $D\,Y(\Omega_x)=I$.

Generally, when receiving HOA content, the encoding matrix is unknown and rendering matrices D should be independent from the content.

Figure 6:
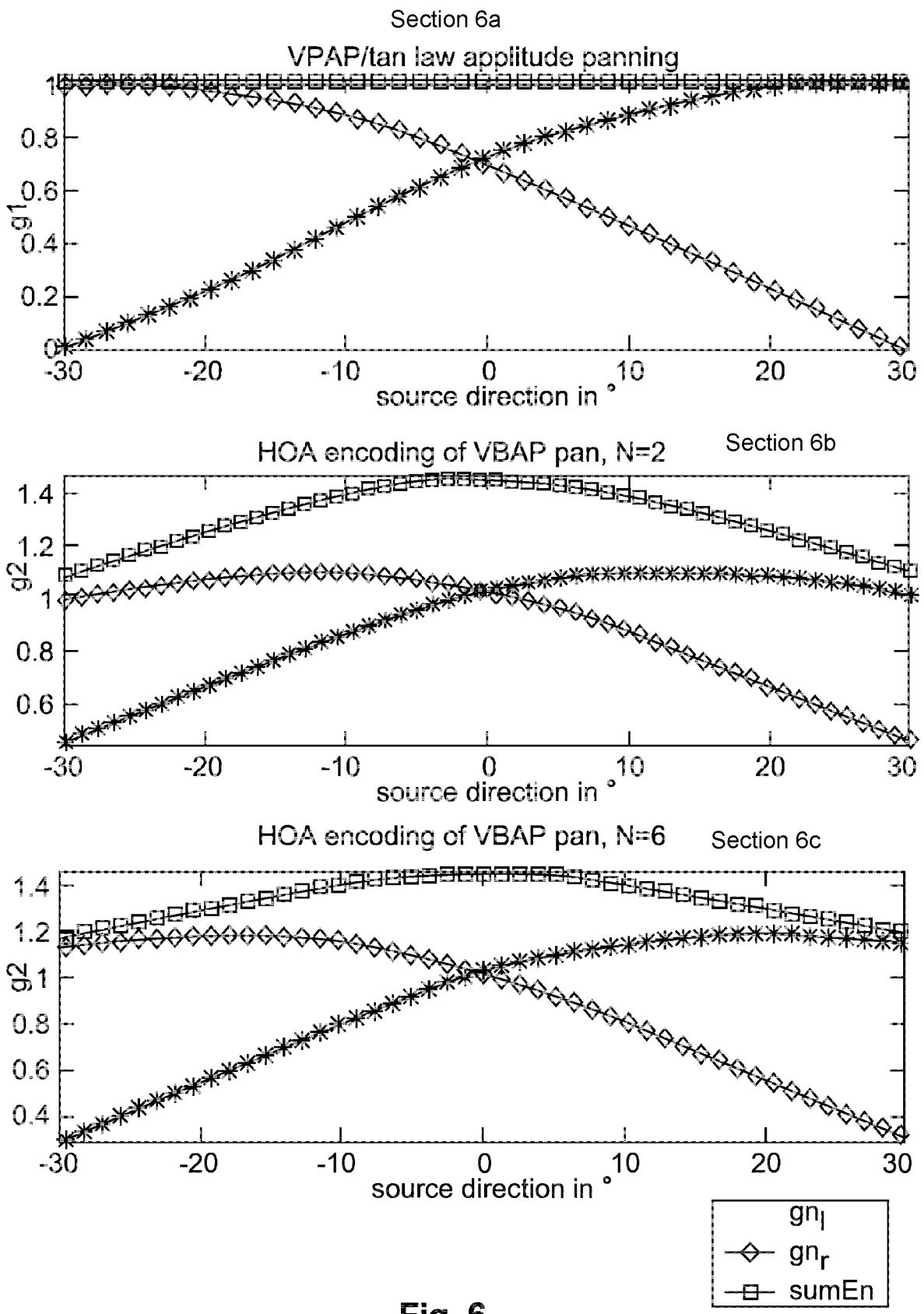
FIG. 6 shows exemplary curves 6*a*, 6*b* and 6*c* related to altering panning directions by naive HOA encoding of two-channel content, for two loudspeaker channels that are 60° apart.

FIG. 6 shows exemplary curves related to altering panning directions by naive HOA encoding of two-channel content, for two loudspeaker channels that are 60° apart. FIG. 6 illustrates panning gains $gn_l$ and $ga_r$ of a signal moving from right to left and energy sum $$\text{sum}En=gn_l^2+gn_r^2 \qquad \text{Equation No. 57}$$

The top part shows VBAP or tangent law amplitude panning gains. The mid and bottom parts show naive HOA encoding and 2-channel rendering of a VBAP panned signal, for N=2 in the mid and for N=6 at the bottom. Perceptually the signal gets louder when the signal source is at mid position, and all directions except the extreme side positions will be warped towards the mid position. Section 6*a* of FIG. 6 relates to VBAP or tangent law amplitude panning gains. Section 6*b* of FIG. 6 relates to a naive HOA encoding and 2-channel rendering of VBAP panned signal for N=2. Section 6*c* relates to naive HOA encoding and 2-channel rendering of VBAP panned signal for N=6.

PAD Approach

Encoding the Signal $$x=as+n \qquad \text{Equation No. 58a}$$

after performing PAD and HOA upconversion leads to $$b_{x2}=y_s s+\mathbf{\Psi}_{\ddot{n}}\,\hat{n}, \qquad \text{Equation No. 58b}$$

with $$\hat{n}=\text{diag}(g_L)\,\ddot{\boldsymbol{n}} \qquad \text{Equation No. 58c}$$

The power estimate of the rendered HOA signal becomes:

$$P_{\hat{x}}=E(b_{x2}^H D^H D b_{x2})\approx E\left(\frac{1}{(N+1)^2}b_{x2}^H b_{x2}\right)=E\frac{1}{(N+1)^2}\left(s^* y_s^H y_s s+\hat{n}^H\Psi_{\ddot{n}}^H\Psi_{\ddot{n}}\hat{n}\right) \qquad \text{Equation No. 59}$$

For N3D normalised SH:

$$y_s^H y_s=(N+1)^2 \qquad \text{Equation No. 60}$$

and, taking into account that all signals of $\hat{n}$ are uncorrelated, the same applies to the noise part:

$$P_{\hat{x}}\approx P_s+\Sigma_{l=1}^L P_{n_l}=P_S+P_N\Sigma_{l=1}^L g_l^2, \qquad \text{Equation No. 61}$$

and ambient gains $g_L=[1,1,0,0,0,0]$ can be used for scaling the ambient signal power $$\Sigma_{l=1}^L P_{n_l}=2P_N \qquad \text{Equation No. 62a}$$

and $$P_{\hat{x}}=P_x. \qquad \text{Equation No. 62b}$$

The intended directionality of s now is given by $Dy_s$ which leads to a classical HOA panning vector which for stage_width $s_W=1$ captures the intended directivity.

HOA Format

Higher Order Ambisonics (HOA) is based on the description of a sound field within a compact area of interest, which is assumed to be free of sound sources, see [1]. In that case the spatio-temporal behaviour of the sound pressure p(t,x) at time t and position $\hat{\Omega}$ within the area of interest is physically fully determined by the homogeneous wave equation. Assumed is a spherical coordinate system of FIG. 2. In the used coordinate system the x axis points to the frontal position, the y axis points to the left, and the z axis points to the top. A position in space $\hat{\Omega}=(r,\theta,\phi)^T$ is represented by a radius r>0 (i.e. the distance to the coordinate origin), an inclination angle $\theta\in[0,\pi]$ measured from the polar axis z and an azimuth angle $\phi\in[0,2\pi[$ measured counter-clockwise in the x-y plane from the x axis. Further, $(\bullet)^T$ denotes the transposition.

A Fourier transform (e.g., see Reference [10]) of the sound pressure with respect to time denoted by $\mathcal{F}_t(\bullet)$, i.e.

$$P(\omega,\hat{\Omega})=\mathcal{F}_t(p(t,\hat{\Omega}))=\int_{-\infty}^{\infty}p(t,\hat{\Omega})e^{-i\omega t}dt, \qquad \text{Equation No. 63}$$

with ω denoting the angular frequency and i indicating the imaginary unit, can be expanded into a series of Spherical Harmonics according to $$P(\omega=kc_s,r,\delta,\phi)=\Sigma_{n=0}^N\Sigma_{m=-n}^n(k)j_n(kr)Y_n^m(\theta,\phi) \qquad \text{Equation No. 64}$$

Here $c_s$ denotes the speed of sound and k denotes the angular wave number, which is related to the angular frequency ω by $$k=\frac{\omega}{c_s}.$$

Further, $j_n(\bullet)$ denote the spherical Bessel functions of the first kind and $Y_n^m(\theta,\phi)$ denote the real valued Spherical Harmonics of order n and degree m, which are defined below. The expansion coefficients $A_n^m(k)$ only depend on the angular wave number k. It has been implicitly assumed that sound pressure is spatially band-limited. Thus, the series is truncated with respect to the order index n at an upper limit N, which is called the order of the HOA representation.

If the sound field is represented by a superposition of an infinite number of harmonic plane waves of different angular frequencies ω and arriving from all possible directions specified by the angle tuple (θ,ϕ), the respective plane wave complex amplitude function B(ω,θ,ϕ) can be expressed by the following Spherical Harmonics expansion $$B(\omega=kc_s,\theta,\phi)=\Sigma_{n=0}^N\Sigma_{m=-n}^n B_n^m(k)Y_n^m(\theta,\phi) \qquad \text{Equation No. 65}$$

where the expansion coefficients $B_n^m(k)$ are related to the expansion coefficients $A_n^m(k)$ by $$A_n^m(k)=i^n B_n^m(k) \qquad \text{Equation No. 66}$$

Assuming the individual coefficients $B_n^m(\omega=kc_s)$ to be functions of the angular frequency ω, the application of the inverse Fourier transform (denoted by $\mathcal{F}^{-1}(\bullet)$ provides time domain functions $$b_n^m(t)=\mathcal{F}_t^{-1}(B_n^m(\omega/c_s))=\frac{1}{2\pi}\int_{-\infty}^{\infty}B_n^m\left(\frac{\omega}{c_s}\right)e^{i\omega t}d\omega \qquad \text{Equation No. 67}$$

for each order n and degree m, which can be collected in a single vector b(t) by $$b(t) = [\, b_0^0(t) \;\; b_1^{-1}(t) \;\; b_1^0(t) \;\; b_1^1(t) \;\; b_2^{-2}(t) \;\; b_2^{-1}(t) \;\; b_2^0(t) \;\; b_2^1(t) \;\; b_2^2(t) \;\; \ldots \;\; b_N^{N-1}(t) \;\; b_N^N(t)]^T. \qquad \text{Equation No. 68}$$

The position index of a time domain function $b_n^m(t)$ within the vector b(t) is given by n(n+1)+1+m. The overall number of elements in the vector b(t) is given by $0=(N+1)^2$. The final Ambisonics format provides the sampled version b(t) using a sampling frequency $f_S$ as $$\{b(lT_S)\}_{l\in\mathbb{N}} = \{b(T_S), b(2T_S), b(3T_S), b(4T_S), \ldots\}, \qquad \text{Equation No. 69}$$

where $T_S=1/f_S$ denotes the sampling period. The elements of $b(lT_S)$ are here referred to as Ambisonics coefficients. The time domain signals $b_n^m(t)$ and hence the Ambisonics coefficients are real-valued.

Definition of Real-Valued Spherical Harmonics

The real-valued spherical harmonics $Y_n^m(\theta,\phi)$ (assuming N3D normalisation) are given by $$Y_n^m(\theta, \phi) = \sqrt{(2n+1)\frac{(n-|m|)!}{(n+|m|)!}}\, P_{n,|m|}(\cos\theta)\, trg_m(\phi) \qquad \text{Equation No. 70a}$$

with $$trg_m(\phi) = \begin{cases} \sqrt{2}\cos(m\phi) & m > 0 \\ 1 & m = 0 \\ -\sqrt{2}\sin(m\phi) & m < 0 \end{cases} \qquad \text{Equation No. 70b}$$

The associated Legendre functions $P_{n,m}(x)$ are defined as $$P_{n,m}(x) = (1-x^2)^{m/2}\frac{d^m}{dx^m}P_n(x),\; m \geq 0 \qquad \text{Equation No. 70c}$$

with the Legendre polynomial $P_n(x)$ and without the Condon-Shortley phase term $(-1)^m$.

Definition of the Mode Matrix

The mode matrix $\Psi^{(N_1,N_2)}$ of order $N_1$ with respect to the directions $$\Omega_q^{(N_2)}, q=1, \ldots, O_2=(N_2+1)^2 (cf.[11]) \qquad \text{Equation No. 71}$$

related to order $N_2$ is defined by $$\Psi^{(N_1,N_2)} := [y_1^{(N_1)} y^{(N_1)} \ldots y_{O_2}^{(N_1)}] \in \mathbb{R}^{O_1\times O_2} \qquad \text{Equation No. 72}$$

with $y_q^{(N_1)}$:

$$= [Y_0^0(\Omega_q^{(N_2)}) Y_{-1}^{-1}(\Omega_q^{(N_2)}) Y_{-1}^0(\Omega_q^{(N_2)}) Y_{-1}^1(\Omega_q^{(N_2)}) Y_{-2}^{-2}(\Omega_q^{(N_2)}) Y_{-1}^{-2}(\Omega_q^{(N_2)}) \ldots Y_{N_1}^{N_1}(\Omega_q^{(N_2)})]^T \in \mathbb{R}^{O_1} \qquad \text{Equation No. 73}$$

denoting the mode vector of order $N_1$ with respect to the directions $\Omega_q^{(N_2)}$, where $O_1=(N_1+1)^2$.

A digital audio signal generated as described above can be related to a video signal, with subsequent rendering.

Figure 7:
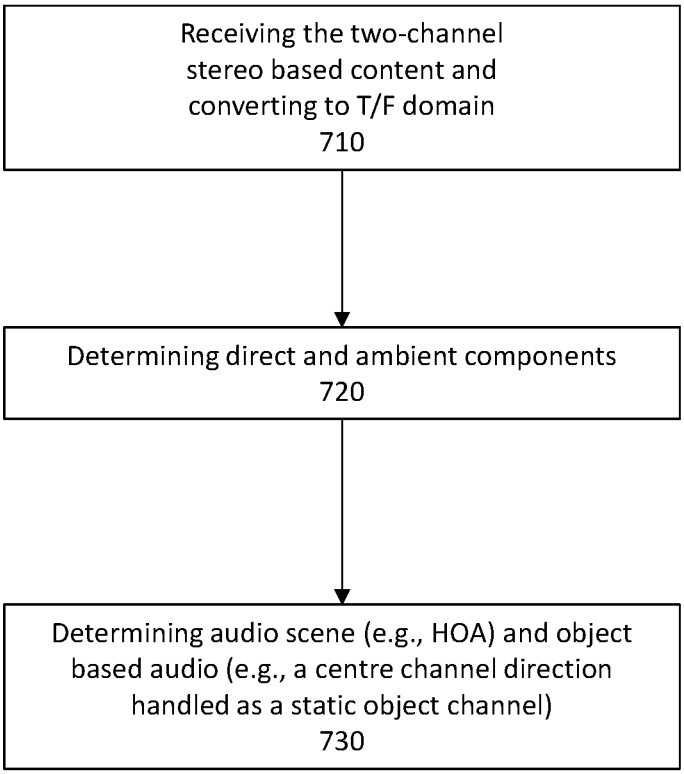
FIG. 7 illustrates an exemplary method for converting two-channel stereo based content to 3D audio scene and object based content.

FIG. 7 illustrates an exemplary method for determining 3D audio scene and object based content from two-channel stereo based content. At 710, two-channel stereo based content may be received. The content may be converted into the T/F domain. For example, at 710, a two-channel stereo signal x(t) may be partitioned into overlapping sample blocks. The partitioned signals are transformed into the time-frequency domain (T/F) using a filter-bank, such as, for example by means of an FFT. The transformation may determine T/F tiles.

At 720, direct and ambient components are determined. For example, the direct and ambient components may be determined in the T/F domain. At 730, audio scene (e.g., HOA) and object based audio (e.g., a centre channel direction handled as a static object channel) may be determined. The processing at 720 and 730 may be performed in accordance with the principles described in connection with A-E and Equation Nos. 1-72.

Figure 8:
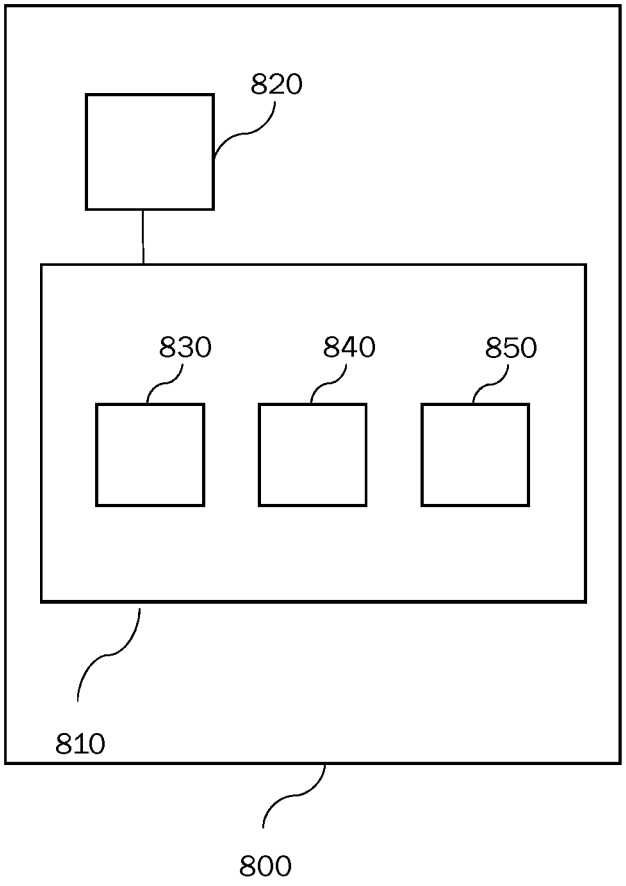
FIG. 8 illustrates an exemplary apparatus configured to convert two-channel stereo based content to 3D audio scene and object based content.

FIG. 8 illustrates a computing device 800 that may implement the method of FIG. 7. The computing device 800 may include components 830, 840 and 850 that are each, respectively, configured to perform the functions of 710, 720 and 730. It is further understood that the respective units may be embodied by a processor 810 of a computing device that is adapted to perform the processing carried out by each of said respective units, i.e. that is adapted to carry out some or all of the aforementioned steps, as well as any further steps of the proposed encoding method. The computing device may further comprise a memory 820 that is accessible by the processor 810.

It should be noted that the description and drawings merely illustrate the principles of the proposed methods and apparatus. It will thus be appreciated that those skilled in the art will be able to devise various arrangements that, although not explicitly described or shown herein, embody the principles of the invention and are included within its spirit and scope. Furthermore, all examples recited herein are principally intended expressly to be only for pedagogical purposes to aid the reader in understanding the principles of the proposed methods and apparatus and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass equivalents thereof.

The methods and apparatus described in the present document may be implemented as software, firmware and/or hardware. Certain components may e.g. be implemented as software running on a digital signal processor or microprocessor. Other components may e.g. be implemented as hardware and or as application specific integrated circuits. The signals encountered in the described methods and apparatus may be stored on media such as random access memory or optical storage media. They may be transferred via networks, such as radio networks, satellite networks, wireless networks or wireline networks, e.g. the Internet.

The described processing can be carried out by a single processor or electronic circuit, or by several processors or electronic circuits operating in parallel and/or operating on different parts of the complete processing.

The instructions for operating the processor or the processors according to the described processing can be stored in one or more memories. The at least one processor is configured to carry out these instructions.

The invention claimed is:

1. A method for determining three-dimensional (3D) audio scene and object based content from two-channel stereo based content, comprising:

receiving the two-channel stereo based content, wherein the two-channel stereo based content is represented by at least a time/frequency (T/F) tile;

determining, for each T/F tile, ambient power, direct power, a source direction, and mixing coefficients of a corresponding T/F tile;

determining, for each T/F tile, a directional signal and at least an ambient T/F channel based on the ambient power, the direct power, and the mixing coefficients of the corresponding T/F tile;

determining the 3D audio scene and the object based content based on the directional signal and the ambient T/F channel, wherein, for each T/F tile, a new source direction is determined based on the source direction for said each T/F/tile, and, when there is a determination that the new source direction is within a predetermined interval, a directional center channel object signal is determined based on the directional signal, the directional center channel object signal corresponding to the object based content, and, when there is a determination that the new source direction is outside the predetermined interval, a directional Higher Order Ambisonics (HOA) signal is determined based on the new source direction.

2. The method of claim 1, wherein, for each T/F tile, additional ambient signal channels based on the at least an ambient T/F channel, and ambient HOA signals are determined based on the additional ambient signal channels.

3. The method of claim 2, wherein, the 3D audio scene content is based on the directional HOA signals and the ambient HOA signals.

4. The method of claim 1, wherein the two-channel stereo signal is partitioned into overlapping sample blocks and the sample blocks are transformed into T/F tiles based on a filter-bank or a fast fourier transform (FFT).

5. Apparatus for generating three-dimensional (3D) audio scene and object based content from two-channel stereo based content, said apparatus comprising:

a receiver for receiving the two-channel stereo based content, wherein the two-channel based content is represented by at least a time/frequency (T/F) tile;

a first processor unit for determining, for each T/F tile, ambient power, direct power, a source direction and mixing coefficients of a corresponding T/F tile;

a second processor unit for determining, for each T/F tile, a directional signal and at least an ambient T/F channel based on the ambient power, the direct power, and the mixing coefficients of the corresponding T/F tile;

a third processor unit for determining the 3D audio scene and the object based content based on the directional signal and the ambient T/F channels, wherein, for each T/F tile, the first processor unit or the second processor unit or the third processor unit is configured to determine a new source direction based on the source direction, and, when there is a determination that the new source direction is within a predetermined interval, a directional center channel object signal is determined based on the directional signal, the directional center channel object signal corresponding to the object based content, and, when there is a determination that the new source direction is outside the predetermined interval, a directional Higher Order Ambisonics (HOA) signal is determined based on the new source direction.

6. The apparatus of claim 5, wherein, for each T/F tile, additional ambient signal channels based on the at least an ambient T/F channel, and ambient HOA signals are determined based on the additional ambient signal channels.

7. The apparatus of claim 6, wherein, the 3D audio scene content is based on the directional HOA signals and the ambient HOA signals.

8. The apparatus of claim 5, the first processor unit or the second processor unit or the third processor unit is further configured to determine to partition the two-channel stereo signal into overlapping sample blocks and the sample blocks are transformed into T/F tiles based on a filter-bank or a fast fourier transform (FFT).

* * * * *